US006436468B2

(12) United States Patent
Iizuka

(10) Patent No.: US 6,436,468 B2
(45) **Date of Patent: *Aug. 20, 2002**

(54) REPAIR COATING PROCESS OF MULTILAYER COATING FILMS

(75) Inventor: Takanobu Iizuka, Hiratsuka (JP)

(73) Assignee: Kansai Paint Co., Ltd., Amagasaki (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/843,729

(22) Filed: Apr. 30, 2001

Related U.S. Application Data

(63) Continuation of application No. 09/332,912, filed on Jun. 15, 1999, now Pat. No. 6,296,899.

(30) Foreign Application Priority Data

Jun. 15, 1998 (JP) ..... 10-166493

(51) Int. Cl.[7] ..... B05D 1/38

(52) U.S. Cl. ..... 427/142; 427/140; 427/487; 427/402; 427/407.1; 427/409; 427/410; 427/419.1; 427/458; 427/521; 427/578; 427/258

(58) Field of Search ..... 427/140, 142, 427/487, 402, 407.1, 409, 410, 419.1, 458, 521, 578, 258

(56) References Cited

U.S. PATENT DOCUMENTS

| | | | | |
|---|---|---|---|---|
| 5,304,400 A | * | 4/1994 | Dhein et al. | 427/388.4 |
| 5,556,527 A | * | 9/1996 | Igarashi et al. | 204/488 |
| 5,718,950 A | | 2/1998 | Komatsu et al. | 427/405 |
| 5,730,644 A | | 3/1998 | Pfanstiehl | 451/28 |
| 5,876,802 A | * | 3/1999 | Brunnemann et al. | 427/409 |
| 6,113,988 A | * | 5/2000 | Borgholte et al. | 427/307.1 |

* cited by examiner

*Primary Examiner*—Shrive P. Beck
*Assistant Examiner*—Jennifer Kolb Michener
(74) *Attorney, Agent, or Firm*—Wenderoth, Lind & Ponack, L.L.P.

(57) ABSTRACT

The present invention provides a repair coating process, the repair coating process consisting of grinding the part of an intermediate coating surface to be repaired and then performing a repair coating of the ground part with a thermocurable organic solvent type repair paint (F) containing a neutralized product of a hydroxyl group-containing resin having an acid value of 5–100 mgKOH/g and a crosslinking agent in forming multilayer coating films by coating an electro-deposition paint (A) and an intermediate paint (B) and curing them by heating, then, after performing a repair coating on the intermediate coating surface, successively coating wet-on-wet a white water base coat (C), a pearly base coat (D), and a clear coat (E), and then curing by crosslinking the films of the above-mentioned coats (C), (D), and (E) simultaneously through heating.

29 Claims, No Drawings

REPAIR COATING PROCESS OF MULTILAYER COATING FILMS

This is a Rule 1.53 (b) Continuation Application of Ser. No. 09/332,912 now U.S. Pat. No. 6,296,899 filed Jun. 15, 1999.

BACKGROUND OF THE INVENTION

1. Field of the Invention

The present invention relates to a repair coating process in order to form multilayer coating films with excellent highly white pearl luster effect, color stability etc.

2. Description of the Related Art

It is already known to form multilayer coating films on an outer panel of a car body etc. by coating with an electrodeposition paint and an intermediate paint and, after curing them, by wet-on-wet coating on the intermediate coating surface with topcoat paints such as a white type water base coat capable of forming a coating film adjusted in the range of Munsell Color Chart N7–N9 with titanium white pigment and aluminium flake, a pearly base coat formed by compounding flake-like mica powder coated with titanium oxide and a clear coat etc., and then by curing by crosslinking these 3-layer coating films simultaneously through heating (for example, U.S. Pat. No. 5,718,950).

In a coating line to form these multilayer coating films on an outer panel of a car body etc., dust may adhere or seediness like projection etc. may generate on the intermediate coating surface and if a topcoat paint is coated as such, finished appearance like smoothness etc. declines which is undesirable. Therefore, it is necessary to previously remove such dust, seediness etc.

Concretely speaking, on the cured intermediate coating film, a part of the coating surface around the point, on which dust, seediness etc. is adhered, is ground spot-wise to remove them. By the grinding usually 20 $\mu$m or more depth of the intermediate coating film (and sometimes a part of the electrodeposition coating film, too) is removed. To the ground part then a repair coating is performed.

As a repair coating process of the ground part there can be mentioned, for example, i) a process to coat a white type water base coat, which would be used at the next step, to the ground part and, leaving it at an uncured state without heat-curing, to coat the same white type water base coat on the whole surface to be coated, ii) a process to coat the intermediate paint, which was used at the previous step, to the ground part and, after curing it by heating, to coat a white type water base coat on the whole surface to be coated, and others.

However, the above-mentioned process i) has a drawback of being prone to generate blistering and/or popping, because the total film thickness of the white type water base coat at the ground part is thicker than that at other unground parts, although a heating step of the repair coating film can be saved. The above-mentioned process ii) does not have such a drawback as mentioned above, but is not favorable in view of shortening process steps, because it contains a heating step.

The main aim of the present invention is to provide a repair coating process, which does not require a heating step and does not generate blistering and/or popping, at the ground part of an intermediate coating film, on which dust, seediness, etc. adhered during a process of forming multilayer coating films by coating a topcoat paint such as a white type water base coat, a pearly base coat, a clear coat etc, on a heat-cured intermediate coating surface by a 3-coat-1-bake process, and its characteristic exists in performing a repair coating to the ground part of an intermediate coating film using a specific hydrophilic organic solvent type paint.

SUMMARY OF THE INVENTION

Namely, the present invention provides a repair coating process of multilayer coating films characterized by grinding the part of an intermediate coating surface to be repaired and then performing a repair coating of the ground part with a thermocurable organic solvent type repair paint (F) containing a neutralized product of a hydroxyl group-containing resin having an acid value of 5–100 mgKOH/g and a crosslinking agent in forming multilayer coating films by coating an electrodeposition paint (A) and an intermediate paint (B) and curing them by heating, then, after performing a repair coating on the intermediate coating surface, by successively coating wet-on-wet a white type water base coat (C) capable of forming a coating film adjusted the Munsell Color Chart to be in the range of N7–N9 with titanium white pigment and aluminium flake, a pearly base coat (D) formed by compounding flake-like mica powder coated with titanium oxide and a clear coat (E), and then by curing by crosslinking the films of the above-mentioned coats (C), (D) and (E) simultaneously through heating.

DESCRIPTION OF THE PREFERRED EMBODIMENTS

The repair coating process of multilayer coating films of the present invention (hereinafter referred to as "the present repair coating process") is described in more detail hereinbelow.

Electrodeposition paint (A)

As the electrodeposition paint (A) usually a cationic electrodeposition paint is used. As the cationic electrodeposition paint there can be used generally those, which are known per se, obtained by compounding an aqueous solution or an aqueous dispersion of a salt of a cationic polymer compound with a crosslinking agent and, as necessary, pigments and various additives, and their kinds are not particularly restricted. As the cationic polymer compound, there can be mentioned, for example, those obtained by introducing an amino group(s) in an acrylic resin or an epoxy resin having a crosslinking functional group(s), for example, hydroxyl group, carboxyl group etc., which will be made water-soluble or water-dispersible by neutralization with an organic acid or an inorganic acid. As a crosslinking agent to be used together in order to cure these resins, for example, a blocked polyisocyanate, an alicyclic epoxy resin etc. are preferable.

Electrodeposition coating can be performed by immersing as a negative electrode metallic materials (substrates) such as an outer panel or colored bumper of a car in a bath of the cationic electrodeposition paint and by depositing the above-mentioned resins on these materials by passing current from a positive electrode under the usual conditions. The thickness of an electrodeposition coating film is preferable in the range of usually 10–40 $\mu$m and particularly 15–30 $\mu$m as the cured film. The coating film can be cured by crosslinking through heating generally at 140–220° C. for 10–40 minutes. In the present repair coating process, it is possible to coat an intermediate paint without curing the electrodeposition coating film, but generally it is preferable to coat the intermediate paint after curing the electrodeposition coating film.

Intermediate Paint (B)

Intermediate paint (B) to be coated on the coating surface of the electrodeposition paint (A) comprises a resin component and a solvent as main components, and, as necessary, color pigments, fillers, other additives for paint etc., and con-tributes to improve the smoothness, image sharpness, gloss etc. of the multilayer coating films to be formed.

Preferable resin component in the intermediate paint (B) is a thermocurable resin composition and specifically includes base resins such as acrylic resin, polyester resin, alkyd resin etc. having a crosslinking functional group(s) (for example, hydroxyl group etc.) in combination with a crosslinking agent such as melamine resin, urea resin, polyisocyanate compound (including blocked product) etc. As the above-mentioned solvent an organic solvent or water can be used.

Intermediate paint (B) can be coated on a crosslink-cured or uncured electrodeposition coating surface by such a method as electrostatic coating, air spray, airless spray etc. Its film thickness is preferable generally in the range of 10–50 μm, particularly 15–40 μm as the cured film. The coating film can be cured by crosslinking through heating usually at 100–170° C.

Grinding of the part to be repaired

According to the present repair coating process, after coating and curing of an electrodeposition paint (A) and an intermediate paint (B), a defect in the coating by dust, seediness etc. on the intermediate coating surface is removed by grinding and the part is repaired by coating with a thermocurable organic solvent type repair paint (F).

Removal of a defective part of the coating caused by dust, seediness etc. on the intermediate coating surface is performed by scraping the coating film with sandpaper or emery cloth manually or using a tool attached with it (sander). it is preferable for obtaining a good finishing of the topcoat film, for example, to first scrape and remove the defective part of the coating by use of sandpaper or emery cloth containing abrasives of relatively coarse particles of #400–600 and then to smoothen the scraped surface by use of sandpaper or emery cloth containing abrasives of fine particle diameter of #1000–1500. It is preferable to wipe the coating surface with an organic solvent such as gasoline in order to remove the coating film powder etc. generated by scraping and to degrease at the same time. Preferable scraping is to be performed only at the above-mentioned defective part of the coating and its surroundings on the intermediate coating surface, so-called spot-wise. Depth of the scraping depends on the size of dust, seediness etc. but is preferable usually within 40 μm and particularly about 10–30 μm. The scraping reaches not only to the intermediate coating film but sometimes to the electrodeposition coating film underneath.

In the present repair coating process, after the removal of the defective part of the coating such as dust, seediness etc. by scraping, the ground part of the intermediate coating surface is repaired by coating with a thermocurable organic solvent type repair paint (F).

Thermocurable organic solvent type repair paint (F):

As the thermocurable organic solvent type repair paint (F) used according to the present repair coating process there can be used a thermocurable organic solvent type paint containing a neutralized product of a hydroxyl group-containing resin (F-1) having an acid value of 5–100 mgKOH/g and a crosslinking agent (F-2) and, as necessary, a color pigment (F-3).

As the hydroxyl group-containing resin (F-1) there are preferably used those containing both carboxyl group and hydroxyl group in the molecule.

The content of the carboxyl group in said resin is preferable in the range of 5–100 mgKOH/g, preferably 10–70 mgKOH/g and more preferably 30–50 mgKOH/g in terms of the acid value. When said acid value is less than the lower limit of the above-mentioned range, the compatibility with the coating film of the white type water base coat (C) to be coated next becomes worse and the ability to absorb the moisture in the coating film of the base coat (C) declines, leading to an easy generation of unevenness, sogging etc. On the other hand, when the acid value is higher than 100 mgKOH/g, the moisture resistance of the coating film of the repair paint (F) itself declines to an undesirable extent. The hydroxyl group contributes to the crosslinking reaction with a crosslinking agent (F-2) and its content is preferable in the range of 10–150 mgKOH/g, particularly 20–100 mgKOH/g and more particularly 30–80 mgKOH/g in terms of the hydroxyl value.

As the hydroxyl group-containing resin (F-1) there are mentioned, for example, acrylic resin, vinyl resin, polyester resin etc. having the above-mentioned functional groups (hydroxyl group and carboxyl group).

The above-mentioned acrylic resin and vinyl resin include polymers obtained by copolymerizing a carboxyl group-containing unsaturated monomer and a hydroxyl group-containing unsaturated monomer and, as necessary, another unsaturated monomer(s). Their number average molecular weight is preferably in the range of about 3000–100000 and particularly about 5000–50000.

Carboxyl group-containing unsaturated monomer is a compound having at least one of each polymerizable unsaturated double bond and carboxyl group in the molecule and includes, for example, acrylic acid, methacrylic acid, maleic acid, itaconic acid, crotonic acid and half monoalkyl esterified products (as said alkyl those with carbon number of 1–10 are preferable) of these dicarboxylic acids. They can be used singly or in combination of more than two.

Hydroxyl group-containing unsaturated monomer is a compound having at least one of each polymerizable unsaturated double bond and hydroxyl group in the molecule and includes, for example, monoesters of acrylic acid or methacrylic acid with glycols with carbon number of 2–10 such as hydroxyethyl acrylate, hydroxyethyl methacrylate, hydroxypropyl acrylate, hydroxypropyl methacrylate etc. They can be used singly or in combination of more than two.

Other unsaturated monomer is a compound having at least one polymerizable unsaturated double bond in the molecule, except the above-mentioned, and include specifically, for example, esters of (meth)acrylic acid with monoalcohols with carbon number of 1–24 such as methyl (meth)acrylate, ethyl (meth)acrylate, propyl (meth)acrylate, butyl (meth) acrylate, pentyl (meth)acrylate, hexyl (meth)acrylate, 2-ethylhexyl (meth)acrylate, lauryl (meth)acrylate etc.; glycidyl group-containing unsaturated monomers such as glycidyl (meth)acrylate etc.; nitrogen-containing unsaturated monomers such as (meth)acrylonitrile, N-methylacrylamide, N-methylolacrylamide, N-butoxymethylacrylamide, dimethylamino-ethyl methacrylate etc.; aromatic ring-containing unsaturated monomers such as styrene, α-methylstyrere, vinyl-toluene etc.; vinyl acetate, vinyl chloride etc. They can be used singly or in combination of more than two.

Acrylic resin is a polymer containing more than 20% by weight of the units derived from the esters of (meth)acrylic acid with monoalcohols with carbon number of 1–24, and vinyl resin is a polymer in which the content of the units derived from said monoesters is less than 20% by weight.

Polyester resin includes oil-free or oil-modified polyester resins prepared by esterification reaction of polyhydric alcohol and polybasic acid, and, as necessary, monobasic acid component (including oil component), and their number average molecular weight is preferably in the range of about 500–50000 and particularly about 3000–30000.

Polyhydric alcohol is a compound having more than two hydroxyl groups in the molecule and includes, for example, ethylene glycol, diethylene glycol, propylene glycol, butanediol, pentanediol, 2,2-dimethylpropanediol, glycerol, trimethylolpropane, pentaerythritol, Cardula E (a product of Shell Chemicals. Co., Ltd.) etc. They can be used singly or in combination of more than two.

Polybasic acid is a compound having more than two carboxyl groups in the molecule and includes, for example, phthalic acid, isophthalic acid, tetrahydrophthalic acid, hexahydrophthalic acid, maleic acid, succinic acid, adipic acid, sebacic acd, trimellitic acid, pyromellitic acid and anhydrides of these acids etc. They can be used singly or in combination of more than two.

Monobasic acid is a compound having one carboxyl group in the molecule and includes, for example, benzoic acid, t-butylbenzoic acid etc. and oil component includes, for example, castor oil, dehydrated castor oil, safflower oil, soybean oil, linseed oil, tall oil, coconut oil and fatty acids constituting these oils.

In a polyester resin, carboxyl group can be introduced, for example, by using together, as a polybasic acid component, a polycarboxylic acid having more than 3 carboxyl groups in the molecule such as trimellitic acid, pyromellitic acid etc., or by half ester addition of a dicarboxylic acid, and hydroxyl group can be easily introduced, for example, by using together, as a polyhydric alcohol component, a polyhydric alcohol having more than 3 hydroxyl groups in the molecule such as glycerol, trimethylolpropane, pentaerythritol etc.

As the hydroxyl group-containing resin (F-1) with an acid value of 5–100 mgKOH/g there can be used graft polymers obtained by grafting acrylic resin or vinyl resin to polyester resin and their number average molecular weight is preferably about 500 to about 40000. The graft polymer is obtained by reacting, for example, polyester resin having polymerizable unsaturated group with the above-mentioned unsaturated monomer.

The neutralized product of the hydroxyl group-containing resin (F-1) used in the thermocurable organic solvent type repair paint (F) is obtained, for example, by neutralization of the carboxyl groups in the hydroxyl group-containing resin (F-1) with an acid value of 5–100 mgKOH/g with a basic substance. The neutralization reaction is preferably conducted before mixing with the crosslinking agent (F-2) etc.

The basic substance is preferably water-soluble and includes, for example, ammonia, methyamine, ethyamine, propylamine, isopropylamine, butylamine, 2-ethylhexylamine, cyclohexylamine, dimethylamine, diethylamine, dipropylamine, diisopropylamine, dibutylamine, trimethyamine, triethyamine, triisopropylamine, tributylamine, ethylenediamine, morpholine, N-alkylmorpholine, pyridine, monoisopropanolamine, methylethanolamine, methylisopropanolamine, dimethylethanolamine, diisopropanolamine, diethanolamine, triethanolamine, diethylethanolamine etc. They can be used singly or in combination of more than two.

The usage of these basic substances is preferably in the range of usually 0.1–2 equivalents and particularly 0.3–1,2 equivalents per carboxyl group in the hydroxyl group-containing resin (F-1) with an acid value of 5–100 mgKOH/g.

Crosslinking agent (F-2) reacts with the hydroxyl group in the hydroxyl group-containing resin (F-1) to crosslink and cure the coating film of the repair paint (F) three-dimensionally, and substances, for example, selected from blocked polyisocyanate compounds, amino resins etc. can be preferably used.

Blocked polyisocyanate compound is a compound obtained by blocking the isocyanate group of a polyisocyanate compound with a blocking agent such as phenols, alcohols, oximes, lactams etc. When heated over the specified temperature (usually 80–160° C.), the blocking agent dissociates to regenerate a free isocyanate group which reacts for crosslinking with the hydroxyl group in the hydroxyl group-containing resin (F-1).

Polyisocyanate compound is a compound having more than 2 isocyanate groups in the molecule and includes, for example, tolylene diisocyanate, diphenylmethane diisocyanate, xylylene diisocyanate, hexamethylene diisocyanate, lysine diisocyanate, methylenebis (cyclohexylisocyanate), isophorone diisocyanate, free isocyanate group-containing prepolymers obtained by reacting these polyisocyanates with low molecular or high molecular polyols in the presence of an excess amount of isocyanate groups, etc. Molecular weight of a blocked polyisocyanate is preferably in the range of generally 200–10000.

As an amino resin there can be mentioned, for example, a methylolized amino resin, in which imino groups may remain, obtained by condensing formaldehyde to a part or all of the amino groups in an amino compound such as melamine benzoguanamine, urea etc.; an alkyl etherified amino resin, in which imino groups and/or methylol groups may remain, obtained by further etherifying a part or all of the methylol groups in said methylolized amino resin with one or more than two kinds of alcohols selected from monoalcohols with carbon number of 1–10, and the like. Number average molecular weight of these amino resins is preferably in the range of generally 400–3000.

Mixing ratio of the neutralized product of the hydroxyl group-containing resin (F-1) and the crosslinking agent (F-2) is preferable generally in the range of 50–90%, particularly 60–80% for the former, and 50–10%, particularly 40–20% for the latter per total solid content of both.

The repair paint (F) is obtained by mixing the above-mentioned neutralized product of the hydroxyl group-containing resin (F-1) and the crosslinking agent (F-2) in an organic solvent.

As an organic solvent a usual known one for paint use can be used and there can be mentioned, for example, solvents of ester type, ether type, alcohol type, amide type, ketone type, aliphatic hydrocarbon type, alicyclic hydrocarbon type, and aromatic hydrocarbon type. It is preferable to use, particularly among them, at least as a part of the organic solvent, a hydrophilic organic solvent such as ethylene glycol monomethyl ether acetate, diethylene glycol monomethyl ether acetate, diethylene glycol monoethyl ether acetate, dioxane, ethylene glycol monomethyl ether, ethylene glycol monoethyl ether, ethylene glycol monobutyl ether, diethylene glycol monomethyl ether, diethylene glycol monoethyl ether, diethylene glycol diethyl ether, diethylene glycol monobutyl ether, propylene glycol monoethyl ether, dipropylene glycol monomethyl ether, methyl alcohol, ethyl alcohol, allyl alcohol, n-propyl alcohol, isopropyl alcohol, tert-butyl alcohol, ethylene glycol, 1,2-propylene glycol, 1,3-butylene glycol, 2,3-butylene glycol, hexylene glycol, hexnaediol, dipropylene glycol, acetone, diacetone alcohol etc. As these hydrophilic organic solvents, for example, organic solvents, which dissolve more than 50 parts by weight per 100 parts by weight of water at 20° C., are preferable. Hydrophilic organic solvents are contained in the repair paint (F) at the coating suitably at the ratio of more than 20% by weight and particularly 40–100% by weight per total weight of the organic solvents.

In the repair paint (F) it is possible to replace a part of these organic solvents with water such as deionized water etc. to make a mixed system of organic solvent and water and to prepare the paint by mixing the above-mentioned individual components therein. In a mixed system of organic solvent and water, it is suitable that organic solvents are in the range of 50–100% by weight and water, 0–50% by weight.

The repair paint (F) may be colorless and transparent without containing any color pigment, but is preferable to be adjusted that its color would be similar or identical with that of the neighboring coating films as underlayer or upperlayer of the intermediate paint (B) or white type water base coat (C). Therefore, the repair paint (F) is a paint of approximately same color as the intermediate paint (B), but is preferable to be a white type paint capable of forming a coating film adjusted in the range of Munsell Color Chart N7–N9 with titanium white pigment and aluminium flake, similarly to the white type base coat (C).

To a repair paint (F) antisettling agent, filler etc. can be suitably mixed, as necessary. The concentration of non-volatile matter at the coating of the repair paint (F) can be in the range of usually 20–65% by weight, but is preferable to be adjusted to 30–65% by weight, particularly 40–60% by weight of a high solid type, by reducing the amount of organic solvent in order to prevent atmospheric pollution and to save resources.

The repair paint (F) is coated spot-wise around the scraped part of the intermediate coating surface, which has been scraped in order to remove the defective coating part caused by dust, seediness etc., by way of air spray, airless spray, electrostatic coating etc., after its viscosity at the coating has been adjusted to 13–60 seconds/Ford cup #4/20° C., preferably 15–40 seconds/Ford cup #4/20° C. Its coating film thickness is most preferably to an extent that the part of the intermediate coating film, which has been removed by scraping, is refilled.

In the present repair coating process, it is preferable to coat the repair paint (F) spot-wise around the scraped part of the intermediate coating surface, then to leave the coating film of the repair paint (F), as necessary, at the normal temperature for 1–20 minutes without curing, and to coat a white type water base coat (C) on the uncured coating surface and the intermediate coating surface, on which the repair paint (F) has not been coated.

White type water base coat (C)

As a white type water base coat (C) in the present repair coating process, a thermocurable water color paint capable of forming a white type coating film adjusted to be in the range of Munsell Color Chart N7–N9 with titanium white pigment and aluminium flake is used. It can coat both the uncured coating surface of the repair paint (F), which has been coated spot-wise around the scraped part of the intermediate coating surface, and the intermediate coating surface, on which the repair paint (F) is not coated.

As such a base coat (C), a thermocurable paint, obtained by mixing resin component, water, titanium white pigment and aluminium flake as essential components, and, as necessary, other color pigment, filler and other additives for paint, is preferable.

As a resin component it is preferable to use a thermocurable resin composition and there can be mentioned specifically, for example, a base resin, having crosslinking functional groups such as hydroxyl group, such as acrylic resin, polyester resin, alkyd resin, urethane resin etc., used together with a crosslinking agent such as melamine resin, urea resin, polyisocyanate compound (including blocked ones) etc. They are used in dissolving or dispersing in water.

Titanium white pigment is a white pigment containing titanium dioxide as main component. Preferable paraticle diameter is generally in the range of 0.2–0.35 μm, particularly 0.25–0.30 μm. Aluminium flake is a flake-like metallic aluminium and is preferable to have a thickness in the range of 0.1–1.0 μm, partically 0.2–0.5 μm, a particle diameter in the range of 1–20 μm, and an average paraticle diameter of less than 10 μm.

The coating film of the base coat (C) is necessary to be a white type, whose formed coating film color is in the range of N7–N9, preferably N7.5–N8.8 based on the Munsell Color Chart, compounded with the above-mentioned titanium white pigment and aluminium flake. Therefor it is preferable to mix, generally, aluminium flake in the ratio of preferably 0.5–10 parts by weight, particularly preferably 1–5 parts by weight of aluminium flake per 100 parts by weight of titanium white pigment, and to make the total amount of both the above-mentioned components to be in the range of 40–250 parts by weight, particularly 80–150 parts by weight per 100 parts by weight of the solid content of the resin component. By adjusting the amount of titanium white pigment and aluminium flake to such a ratio, it is possible to form a white to pale gray coating film without a glittering impression, and to form multilayer coating films with an excellent pearl lustre effect of white pearly type or silver pearly type, by coating a pearly base coat (D) on such base coat (C) coating surface.

Base coat (C) can be coated by way of electrostatic coating, air spray, airless spray etc. Its preferable thickness is in the range of generally 5–20 μm, particularly 8–15 μm based upon the cured coating film. Said coating film itself may be cured by crosslinking at about 100 to about 170° C., but in the present repair coating process it is not cured, but the base coat (D) is coated on said coating surface in an uncured state.

Pearly base coat (D)

As the pearly base coat (D) to be coated on the uncured coating surface of the white type water base coat (C) according to the present process, a liquid paint, obtained by mixing resin component, flake-like mica powder, coated with titanium oxide, and solvent as main components, and further, as necessary, color pigment, filler, other additives for paint etc. can be used.

As a resin component it is preferable to use a thermocurable resin composition and there can be mentioned specifically, for example, a base resin, having crosslinking functional groups such as hydroxyl group, such as acrylic resin, polyester resin, alkyd resin, urethane resin etc., used together with a crosslinking agent such as melamine resin, urea resin, polyisocyanate compound (including blocked ones) etc. They can be used in dissolving or dispersing in organic solvent and/or water.

Flake-like mica powder coated with titanium oxide is generally called as white mica or silver mica, non-iridescent and is distinguished from iridescent mica. Specifically, it is a product obtained by coating the surface of flake-like mica powder with titanium oxide and its preferable size is generally in the range of 5–60 μm, particularly 5–25 μm in the maximum diameter and 0.25–1.5 μm, particularly 0.5–1 μm in thickness. In order to finish the multilayer coating films to be formed by the present repair coating process in white pearly type or silver pearly type the preferable thickness of titanium oxide coating the surface of flake-like mica powder is in the range of 90–160 nm, particularly 110–150 nm based upon the optical thickness and 40–70 nm, particularly 50–65 nm based upon the geometrical thickness.

The mixing amount of the flake-like mica powder coated with titanium oxide is not strictly restricted, but is preferable usually in the range of 3–20 parts by weight, particularly 7–13 parts by weight per 100 parts by weight of the total solid content of the resin component.

To the pearly base coat (D) there can be further mixed, as necessary, flake pigment such as silver-plated glass flake, titanium-coated graphite, metallic titanium flake, plate-like iron oxide, phthalocyanine flake etc.

The above-mentioned pearly base coat (D) can be coated on the uncured coating surface of the white type water base coat (C) by way of electrostatic coating, air spray, airless spray etc. Its preferable thickness is in the range of 5–20 μm, particularly 8–13 μm based upon the cured coating film. In addition, the total coating thickness of the base coat (C) and the base coat (D) is preferably less than 30 μm, particularly in the range of 15–25 μm based upon the cured coating film.

The coating film of the base coat (D) itself may be cured by crosslinking at about 100 to about 170° C., but in the present repair coating process it is not completely cured but the clear coat (E) is coated on the coating surface.

Clear coat (E)

As the clear coat (E) is used in the present repair coating process, a liquid paint, obtained by mixing resin component and solvent as main component, and further, as necessary, color pigment, other additives for paint, etc. to such an extent as not to deteriorate the transparent impression of the coating film, can be used. As a resin component used for the clear coat (E) is preferably a thermocurable resin compositin and there can be mentioned specifically, for example, a base resin, having crosslinking functional groups such as hydroxyl group, such as acrylic resin, polyester resin, alkyd resin, urethane resin etc., used together with a crosslinking agent such as melamine resin, ures resin, polyisocyanate compound (including blocked ones) etc. As a solvent, an organic solvent and/or water can be used.

The clear coat (E) can be coated on the coating surface of the base coat (D) in an uncured state by way of electrostatic coating, air spray, airless spray etc. Its preferable thickness is usually in the range of 10–100 μm, particularly 15–60 μm based upon the cured coating film. The coating film of the clear coat (E) itself can be cured by crosslinking at about 100 to about 170° C.

In the present repair coating process, after coating all of the repair paint (F), the white type water base coat (C), the base coat (D) and the clear coat (E), these coating films are simultaneously cured by crosslinking through heating to about 100 to about 170° C. Moreover, it can be conducted by process steps consisting of the repair paint (F) coating—leaving at room temperature—the base coat (C) coating—leaving at room temperature—the base coat (D) coating—leaving at room temperature—the clear coat (E) coating—curing by heating, or any one, two or all of the three leavings at room temperature can be replaced by preliminary drying at about 50 to about 100° C. The preliminary drying is preferably conducted to such an extent that the gel fraction ratio of each coating film remains less than 60% by weight.

The following effects can be obtained according to the above-mentioned present repair coating process.

(1) The color base coat (C), used in the present repair coating process and forming a coating film adjusted to be in the range of Munsell Color Chart N7–N9 with both components of titanium white pigment and aluminium flake has such an excellent hiding power as to be able to form multilayer coating films, whose highly white pearl luster effect, color stability etc. are greatly improved, although the total thickness of both coating films of the above-mentioned base coats (C) and (D) is so thin as less than 30 μm.

(2) The flake-like mica powder, coated with titanium oxide, used in the pearly base coat (D) is pearly and can form multilayer coating films with execllent highly white pearl luster effect, color stability etc. by coating on the coating surface of the white type water base coat (C).

(3) The neutralized product of the hydroxyl group-containing resin (F-1) with an acid value of 5–100 mgKOH/g in the repair paint (F) is hydrophilic and has such a strong water-absorbing property that water in the white type water base coat (C) is absorbed in the coating film of the repair paint (F) underneath, when the base coat (C) is coated on the uncured coating surface of the repair paint (F), thus eliminating the drawback that the ground part is prone to generate blistering and/or popping.

The present repair coating process is described hereinafter more specifically by way of Examples and Comparative Examples Parts and % in the following description are by weight and the film thickness of a coating film is based upon the cured coating film.

I. Materials (1) Cationic electrodeposition paint: "ELECRON 9400HB"; a product of Kansai Paint Co., Ltd.; a compounded product of epoxy resin/polyamine type cationic resin and a blocked polyisocyanate compound as a curing agent.

(2) Intermediate paint: "LUGA BAKE Intermediate Gray"; a product of Kansai Paint Co., Ltd.; polyester resin/melamine resin type; organic solvent type.

(3) White type water base coats (C-1) and (C-2): Water paints obtained by mixing titanium white pigment and aluminium flake in the ratios shown in Table 1 per 100 parts by weight (solid content) of the resin component consisting of hydroxyl group-containing acrylic resin and melamine resin.

TABLE 1

| White type water base coat (C) | C-1 | C-2 |
|---|---|---|
| Acrylic resin (*1) | 70 | 70 |
| Melamine resin (*2) | 30 | 30 |
| Titanium white pigment (*3) | 100 | 100 |
| Aluminium flake (*4) | 2.5 | 1.3 |
| Munsell Chart N value | 8.4 | 8.8 |

(*1) Acrylic resin: Hydroxyl value: 110, acid value: 50, number average molecular weight: 25000; neutralized with dimethylethanolamine.
(*2) Melamine resin: Butyl etherifed melamine resin.
(*3) Titanium white pigment: A product of Tayca Corporation; rutile type titanium oxide pigment; particle diameter: 0.25–0.30 μm.
(*4) Aluminum flake: A product of Toyo Aluminum K.K.; non-leafing aluminum flake paste; thickness: 0.2–0.5 μm, average particle diameter: less than 10 μm.

(4) Base coat (D-1): An organic solvent type paint obtained by mixing 70 parts of hydroxyl group-containing acrylic resin (*5), 30 parts of butylated melamine resin (*6) and 10 parts of flake-like mica coated with titanium oxide (maximum diameter: 10–20 μm, thickness: 0.5–1 μm; optical thickness of titanium oxide: about 140 nm, geometric thickness: about 60 nm; trade name: "IRIODIN 103R" available from E. Merck KGaA); solid content: 20%.

(*5) Hyroxyl group-containing acrylic resin: Hydroxyl value: 100; number average molecular weight: 20000.

(*6) Butylated melamine resin: Methyl-butyl mixed etherified melamine resin.

(5) Base coat (D-2): A water paint obtained by adding 10 parts of flake-like mica coated with titanium oxide (the above-mentioned "IRIODIN 103R") per 100 parts (solid content) of the resin solid content of the equeous emulsion of the resin composition consisting of 65 parts of hydroxyl group-containing acrylic resin (*7), 15 parts of urethane resin (*8) and 20 parts of melamine resin (*9) and by adjusting the solid content to 20%.

(*7) Hyroxyl group-containing acrylic resin: Emulsion with average particle diameter of 0.1 μm and hydroxyl value of 35. Neutralized with dimethylethanolamine.

(*8) Urethane resin: Water-extended emulsion. Neutralized with trimethylamine.

(*9) Melamine resin: "U-VAN 28SE"; a product of Mitsui Chemicals, Inc.; a hydrophobic melamine resin.

(6) Clear coat (E): "LUGA BAKE CLEAR"; a product of Kansai Paint Co., Ltd.; acrylic resin/amino resin type; organic solvent type.

(7) Repair paint (F-1)-(F-3): Organic solvent type paints obtained by mixing neutralized solution of acrylic resin (*10), neutralized solution of polyester resin (*11), CYMEL 370 (*12), titanium white pigment (*3), alumunium flake (*4) and isopropyl alcohol in the ratios shown in Table 2.

TABLE 2

| | F-1 | F-2 | F-3 |
|---|---|---|---|
| Neutralized solution of acrylic resin (*10) | 140 | 140 | |
| Neutralized solution of polyester resin (*11) | | | 117 |
| CYMEL 370 (*12) | 34 | 34 | 34 |
| Titanium white pigment (*3) | 100 | 100 | 100 |
| Alumunium flake (*4) | 2.5 | 1.3 | 1.3 |
| Isopropyl alcohol | 140 | 150 | 125 |

(*10) Neutralized solution of acrylic resin: In a reaction vessel 60 parts of butylcellosolve was added and heated to 120° C., to which monomer mixture (30 parts of methyl methacrylate, 23 parts of ethyl acrylate, 30 parts of butyl acrylate, 12 parts of hydroxyethyl methacrylate, 5 parts of acrylic acid and 2 parts of α,α'-azobisisobutylonitrile) was added in 3 hours using a dosing pump and polymerized to obtain an acrylic resin solution with an acid value of 40, hydroxyl value of 52, number average molecular weight of 10000 and resin solid content of 60%. 100 parts of the resin solution was neutralized by adding 3.5 parts of dimethylaminoethanol and then diluted with isopropyl alcohol to obtain a neutralized organic solvent solution of acrylic resin with resin solid content of 50%.

(*11) Neutralized solution of polyester resin: In a reaction vessel 0.7 mol of neopentyl glycol, 0.3 mol of trimethylolpropane, 0.4 mol of phthalic anhydride and 0.5 mol of adipic acid were added and reacted at 200–230° C. for 5 hours, and then 0.03 mol of trimellitic anhydride was added and further reacted at 180° C. for 1 hour. Then butylcellosolve was added to the reaction mixture to obtain a polyester resin solution with an acid value of 40, number average molecular weight of 6000 and resin solid content of 70%. 100 parts of the resin solution was neutralized by adding 4 parts of dimethylaminoethanol and then diluted with isopropyl alcohol to obtain a neutralized organic solvent solution of polyester resin with resin solid content of 60%.

(*12) CYMEL 370: A product of Mitsui Cytec, Ltd; water-soluble melamine resin.

(*10) Neutralized solution of acrylic resin: In a reaction vessel 60 parts of butylcellosolve was added and heated to 120° C., to which monomer mixture (30 parts of methyl methacrylate, 23 parts of ethyl acrylate, 30 parts of butyl acrylate, 12 parts of hydroxyethyl methacrylate, 5 parts of acrylic acid and 2 parts of α, α' -azobisisobutylonitrile) was added in 3 hours using a dosing pump and polymerized to obtain an acrylic resin solution with an acid value of 40, hydroxyl value of 52, number average molecular weight of 10000 and resin solid content of 60%. 100 parts of the resin solution was neutralized by adding 3.5 parts of dimethylaminoethanol and then diluted with isopropyl alcohol to obtain a neutralized organic solvent solution of acrylic resin with resin solid content of 50%.

(*11) Neutralized solution of polyester resin: In a reaction vessel 0.7 mol of neopentyl glycol, 0.3 mol of trimethylolpropane, 4.0 mol of phthalic anhydride and 0.5 mol of adipic acid were added and reacted at 200–230° C. for 5 hours, and then 0.03 mol of trimellitic anhyddride was added and further reacted at 180° C. for 1 hour. Then butylcellosolve was added to the reation mixture to obtain a polyester resin solution with an acid value of 40, number average molecular weight of 6000 and resin solid content of 70%. 100 parts of the resin solution was neutralized by adding 4 parts of dimethylaminoethanol and then diluted with isopropyl alcohol to obtain a neutralized organic solvent solution of polyester resin with resin solid content of 60%.

(*12) CYMEL 370: A product of Mitsui Cytec, Ltd; water-soluble melamine resin.

II. Examples and Comparative Examples

On a degreased and zinc phosphate-treated steel plate (JISG 3141; size: 400×300×0.8 mm) the catonic electrodeposition paint was coated by electrodeposition in a usual way to obtain a film with 20 μm thickness and cured by crosslinking through heating at 170° C. for 20 minutes, then to said electrodeposition coating surface the intermediate paint was coated to obtain a film with 30 μm thickness and cured by cosslinking through heating at 140° C. for 30 minutes.

A part of the intermediate coating surface was ground with a water resistant sandpaper with roughness of #600. Ground area was about 40×30 mm and the maximum depth of the ground part was 30 μm.

Then repair paints (F-1)–(F-3) were coated on the ground part of the intermediate coating surface. The coating was preferably so conducted as to refill the part from which the intermediate coating film had been removed by grinding and to make the cured surface, on which the repair paint was coated, and the uncoated intermediate coating surface smooth without unevenness after the coating. In Comparative Examples the white type water base coats (C-1) and (C-2) to be used at the next step were coated as repair paint.

After leaving the repaired coating film at the room temperature for 5 minutes without curing, the white type water base coats (C-1) and (C-2) were coated by use of a Minibell type rotary electrostatic coater on the whole surface at the booth temperature of 20° C. and booth humidity of 75%. Coating film thickness was 10 μm. After leaving it at the room temperature for 5 minutes, to the base coat film surface the pearly base coats (D-1) and (D-2) were coated by use of a REA gun at 20° C. and humidity of 75%. Coating film thickness was 8–10 μm. After leaving it at the room temperature for 5 minutes, to the coating film surface the clear coat (E) was coated by use of a Minibell type rotary electrostatic coater at 20° C. and humidity of 75%. Coating film thickness was 25 μm. After leaving it at the room temperature for 3 minutes, the multilayer coating films consisting of the repair paint, white type water base coat, pearly base coat and clear coat were simultaneously cured by crosslinking through heating at 140° C. for 30 minutes in a hot air circulating drying oven.

III. Performance test results

The coating steps of the above-mentioned paints and the performance test results of the obtained multilayer coating films are shown in Table 3. In the drying in Table 3, W means the film was left at the room temperature for 3–5 minutes after the coating.

TABLE 3

| | Example | | | Comparative Example | |
|---|---|---|---|---|---|
| | 1 | 2 | 3 | 1 | 2 |
| Cationic electrodeposition paint | ELECRON 9400HB | | | | |
| Curing | 170° C., 20 minutes | | | | |
| Intermediate paint | LUGA BAKE Intermediate | | | | |
| Curing | 140° C., 30 minutes | | | | |
| Repair paint | F-1 | F-2 | F-3 | C-1 | C-2 |
| Drying | W | W | W | W | W |
| White base coat | C-1 | C-2 | C-2 | C-1 | C-2 |
| Drying | W | W | W | W | W |
| Pearl base | D-1 | D-1 | D-2 | D-1 | D-2 |
| Drying | W | W | W | W | W |
| Clear coat | E | E | E | E | E |
| Curing | 140° C., 30 minutes | | | | |
| Performance test results | | | | | |
| Black/white hiding power | 9 | 10 | 9 | 20 | 20 |
| Intermediate coating film hiding power | 8 | 9 | 8 | 18 | 18 |
| Pearl luster effect SV/IV | 270/116 | 250/115 | 270/116 | 240/110 | 230/109 |
| Unevenness | ○ | ○ | ○ | Δ | X |
| Coating film appearance | ○ | ○ | ○ | X | X |

The methods of the performance test in Table 3 are as follows.

Hiding power (black/white, intermediate coating film): According to the description of "hiding power" of JISK5400, the minimum film thickness of a color base coat necessary to hide the black/white ground or the intermediate coating film was measured. The thinner the film thickness, the higher the hiding power.

Pearl luster effect: SV value and IV value were measured by use of ALCOPELMR100 (a product of FUJI IND. LTD.). SV value is represented by the signal output SV at the light receiving angle, at which the reflective light of the laser irradiated at the angle of incidence of 45 degrees becomes minimum light intensity in the high-light region and shows the intensity of the diffusion reflective light (whiteness, light scattering rate) from the flake-like mica. The higher the value, the higher the whiteness. IV value is represented by the signal output IV at the light receiving angle, at which the maximum light intensity is obtained, excluding the light in the specular gloss region which reflects at the clear surface, among the reflective light of the laser irradiated at the angle of incidence of 45 degrees and shows the intensity of the reflective light (brightness, metallic luster) from the flake-like mica. The higher the value, the higher the metallic luster impression.

Unevenness: Visual evaluations performed in a room by 10 skilled evaluaters of the finishing of coating film were summarized comprehensively. ○ means good and Δ, fair, X, bad, respectively.

Coating film appearance: Generation of blistering and/or popping at the multilayer coating films was observed visually. ○ shows that no generation of blistering or popping at all, Δ, generation of blistering and/or popping is observed a little, X, generation of blistering and/or popping is observed much.

What is claimed is:

1. In a process for producing a multilayer coating film which comprises applying successively an electrodeposition paint (A) and an intermediate paint (B) to form an intermediate coating surface, and then applying a water-base top paint, the improvement comprising performing a repair operation to correct a defect in the intermediate coating surface prior to the application of the water-base top coating, said repair operation comprising grinding a defective part of the intermediate coating surface and then coating a thermocurable organic solvent repair paint (F) to the ground defective part, said thermocurable organic solvent repair paint (F) comprising (i) a neutralized product of a hydroxyl group-containing resin having an acid value of 5–100 mg KOH/g, (ii) a crosslinking agent and (iii) a hydrophilic organic solvent in an amount of at least 20% by weight based on the total weight of organic solvent.

2. The process according to claim 1, wherein the intermediate coating surface is formed by coating the electrodeposition paint (A) and the intermediate paint (B) on a substrate and curing the electrodeposition paint (A) and the intermediate paint (B) on the substrate by heating.

3. The process according to claim 1, further comprising after the coating of the thermocurable organic solvent repair paint (F), successively coating wet-on-wet (1) a white coloring water base coat (C) which forms a coating film adjusted to the range of Munsell Color Chart N7–N9 with titanium white pigment and aluminium flake, (2) a pearly base coat (D) formed by compounding flake mica powder coated with titanium oxide and (3) a clear coat (E), and then heating the above-mentioned coats(1), (2) and (3) to simultaneously cure the coats (1), (2) and (3) by crosslinking.

4. The process according to claim 2, wherein the electrodeposition paint (A) is a cationic electrodeposition paint.

5. The process according to claim 2, wherein the electrodeposition paint (A) is coated at a thickness of about 10–40 $\mu$m as a cured film.

6. The process according to claim 2, wherein the intermediate paint (B) is coated after the coated electrodeposition paint (A) has been cured.

7. The process according to claim 2, wherein the intermediate paint (B) is coated at a thickness of about 10–50 $\mu$m as a cured film.

8. The process according to claim 1, wherein the defective part of the intermediate coating surface is caused by dust and/or seediness.

9. The process according to claim 1, wherein the grinding of the defective part is performed with sandpaper or emery cloth.

10. The process according to claim 1, wherein the grinding of the defective part is performed by scraping and removing the defective part of the intermediate coating surface using sandpaper and/or emery cloth having abrasives of relatively coarse particles and then by smoothing the scraped defective part of the intermediate coating surface using sandpaper and/or emery cloth having abrasives of the fine particles.

11. The process according to claim 1, wherein the grinding is performed spot-wise.

12. The process according to claim 1, wherein the grinding is performed to a depth of within 40$\mu$m.

13. The process according to claim 1, wherein the hydroxyl group containing resin comprises a carboxyl group and a hydroxyl group.

14. The process according to claim 13, wherein the carboxyl group is in an amount of about 10–70 mgKOH/g based upon the acid value.

15. The process according to claim 13, wherein the carboxyl group is in an amount of about 30–50 mgKOH/g based upon the acid value.

16. The process according to claim 1, wherein the hydroxyl group containing resin comprises hydroxyl group in an amount of about 10–150 mgKOH/g based upon the hydroxyl value.

17. The process according to claim 16, wherein the hydroxyl group containing resin comprises hydroxyl group in an amount of about 20–100 mgKOH/g based upon the hydroxyl value.

18. The process according to claim 1, wherein the hydroxyl group containing resin is an acrylic resin, a vinyl resin or a polyester resin, each of which comprises a carboxyl group and a hydroxyl group.

19. The process according to claim 1, wherein the crosslinking agent is selected from the group consisting of blocked polyisocyanate compounds and amino resins.

20. The process according to claim 1, wherein the thermocurable organic solvent repair paint (F) comprises about 50–90% of the neutralized product of the hydroxyl group containing resin and about 50–10% of the crosslinking agent based upon the total solid content weight of both components.

21. The process according to claim 20, wherein the thermocurable organic solvent repair paint (F) comprises about 60–80% of the neutralized product of the hydroxyl group containing resin and about 40–20% of the crosslinking agent based upon the total solid content weight of both components.

22. The process according to claim 1, wherein the hydrophilic organic solvent is in an amount of at least 40% by weight based upon the total weight of the organic solvent.

23. The process according to claim 2, wherein the thermocurable organic solvent repair paint (F) is adjusted to have a similar or identical color as the intermediate paint (B).

24. The process according to claim 3, wherein the thermocurable organic solvent repair paint (F) is adjusted to have a similar or identical color as the white coloring water based paint (C).

25. The process according to claim 3, wherein the thermocurable organic solvent repair paint (F) coated on the defective ground part of the intermediate coating surface is coated, without being cured, with the coats (1), (2) and (3) wet-on-wet, and simultaneously cured by crosslinking.

26. The process according to claim 3, wherein the white coloring water base paint (C) forms a coating film in the range of Munsell Color Chart N7.5–N8.8.

27. The process according to claim 3, wherein the white coloring water base coat (C) and the pearly base coat (D) is coated at a total thickness of about less than 30 $\mu$m as a cured film.

28. The process according to claim 3, wherein the coats (1), (2) and (3) are heated at a temperature of about 100° C. to about 160° C.

29. An article having a multilayer coating film repaired by the process according to claim 1.

* * * * *